US012527397B2

(12) United States Patent
Evans

(10) Patent No.: US 12,527,397 B2
(45) Date of Patent: Jan. 20, 2026

(54) EXTENDABLE HANDGUN STORAGE DEVICE

(71) Applicant: Mark Evans, Portland, TN (US)

(72) Inventor: Mark Evans, Portland, TN (US)

( * ) Notice: Subject to any disclaimer, the term of this patent is extended or adjusted under 35 U.S.C. 154(b) by 0 days.

(21) Appl. No.: 18/424,448

(22) Filed: Jan. 26, 2024

(65) Prior Publication Data

US 2024/0251945 A1 Aug. 1, 2024

Related U.S. Application Data

(60) Provisional application No. 63/441,423, filed on Jan. 26, 2023.

(51) Int. Cl.
*A47B 81/00* (2006.01)
*F41A 23/18* (2006.01)

(52) U.S. Cl.
CPC ..... *A47B 81/005* (2013.01); *F41A 23/18* (2013.01)

(58) Field of Classification Search
CPC ..... A47B 61/02; A47B 81/005; F41C 33/06; F41A 23/18
USPC ..... 211/64, 94.01
See application file for complete search history.

(56) References Cited

U.S. PATENT DOCUMENTS 1,132,190 A * 3/1915 Kohout ..... A47G 25/746 211/85.3
2,683,890 A * 7/1954 Rosenbaum ..... A47H 15/04 16/95 D
3,124,253 A * 3/1964 Petrick ..... A47G 25/746 211/94.01
3,954,182 A * 5/1976 McEvers ..... A47G 25/746 211/94.01
D273,645 S * 5/1984 McEvers ..... D6/513
D277,436 S * 2/1985 Benedict ..... D6/315
D320,713 S * 10/1991 Greenhut ..... D6/513
6,227,387 B1 * 5/2001 Rose ..... A47J 47/16 211/113
6,463,944 B2 * 10/2002 Heiberg ..... B08B 3/12 134/201
6,871,749 B2 * 3/2005 Bostick ..... A47B 61/02 211/94.01
7,490,424 B2 * 2/2009 Caterinacci ..... G09F 7/20 40/606.14
8,292,094 B2 10/2012 Morton
8,739,982 B2 6/2014 Werner
9,022,237 B2 5/2015 Hall
9,046,315 B2 * 6/2015 Rivoli ..... F41A 23/18
9,140,049 B2 9/2015 Suggs
9,247,811 B2 2/2016 Spencer
9,848,700 B2 * 12/2017 Corless ..... A47B 88/443
10,053,023 B2 * 8/2018 Nero ..... B60R 11/06
11,571,064 B2 * 2/2023 Streets ..... A47B 61/02
11,903,482 B2 * 2/2024 Honermann ..... F41C 33/06
11,969,110 B2 * 4/2024 Streets ..... A47G 25/0692
12,042,044 B2 * 7/2024 Honermann ..... F41C 27/00
12,226,012 B1 * 2/2025 Newell ..... A47B 77/04
(Continued)

*Primary Examiner* — Patrick D Hawn
(74) *Attorney, Agent, or Firm* — CARRITHERS LAW OFFICE, PLLC; Adam D. Carrithers; David W. Carrithers

(57) ABSTRACT

A storage device comprising a mounting bracket, a sliding assembly, and at least one mount by which to provide an interface for hanging and storing handguns within a cabinet or other suitable storage space whereby the sliding assembly can project outward from the storage device for unencumbered access to the handguns.

39 Claims, 5 Drawing Sheets

(56) References Cited

U.S. PATENT DOCUMENTS

| | | | | |
|---|---|---|---|---|
| 12,226,032 | B1 * | 2/2025 | Honermann | A47F 5/0093 |
| 2006/0283820 | A1 | 12/2006 | Peters | |
| 2008/0245753 | A1 * | 10/2008 | Spriegel | B25H 3/04 211/13.1 |
| 2011/0000864 | A1 * | 1/2011 | Moore | A47J 45/02 211/85.29 |
| 2013/0306817 | A1 * | 11/2013 | Smed | F16M 13/022 248/323 |
| 2014/0002739 | A1 | 1/2014 | Stepp | |
| 2016/0018052 | A1 | 1/2016 | Herman | |
| 2018/0279778 | A1 | 10/2018 | Martinage | |
| 2019/0063871 | A1 | 2/2019 | Cain | |
| 2019/0104844 | A1 | 4/2019 | Garrett | |

* cited by examiner

EXTENDABLE HANDGUN STORAGE DEVICE

CROSS REFERENCES TO RELATED APPLICATIONS

This application claims priority from U.S. Provisional Application Ser. No. 63/441,423 filed on Jan. 26, 2023 and is incorporated herein in its entirety.

FIELD OF THE INVENTION

The present invention relates generally to a storage device for organizing and storing handguns on a fully extendable and retractable support, wherein the storage device may be attached to the underside of an existing horizontal surface in a gun safe or storage cabinet.

BACKGROUND OF THE INVENTION

Proper storage of firearms inhibits theft by criminals and protects children or inexperienced adults from accessing and mishandling the guns. Responsible sportsmen who use or collect firearms should have a means by which to safely store and secure said firearms.

A quality gun safe, lockable cabinet, or lockable storage locker, whether homemade or commercial, are some of the most secure options for securing firearms. Gun safes come in different sizes and configurations to best serve their user, ranging from single weapon safes for storing a handgun to large standup safes for storing dozens of long guns with additional storage shelves and drawers. There remains room for improvement to these safes with respect to the most efficient and convenient ways by which to store the firearms and their accessories such as magazines and ammunition.

It is common that rifles and shotguns are stored in a vertical manner in a bottom portion of a storage container and that handguns are stored on the shelves of a standup safe or storage cabinet, though this causes many inconveniences. One of the inconveniences of storing handguns is that, by convention, a handgun is stored by laying it on its side. This orientation, though the most stable, also uses the greatest amount of shelf space, and thereby reduces the number of firearms which can be placed on a single shelf. It is undesirable to stack handguns, as bumping and rubbing against other firearms may damage the gun or mar its decorative surfaces and finishes. In some situations, the handgun can be placed in its original container and then stacked on the shelf. However, stacking the containers can make it difficult to remove a particular gun that is arranged at the bottom of the stack or towards the rear of the shelf.

There is a desire to increase the effective storage capacity of gun safes and increase the ease with which the firearms can be retrieved. Numerous innovations for gun storage devices have been provided in the prior art and will be described below.

A gun cabinet containing drawers for effectively using the interior space of a gun safe is described in U.S. patent Ser. No. 10/716,397, which is incorporated herein by reference in its entirety. The invention teaches a cabinet having tall drawers which can be pulled forward from the cabinet to facilitate the removal of guns from the cabinet. Storage shelves are included between the tall drawers for the storage of ammunition, shooting accessories, handguns, and the like. The design of the drawers in the invention are directed towards storing long guns which must be stood in a vertical orientation to fit inside the safe.

A sliding gun safe panel is described in U.S. Patent Publication No. 2019/0063871, which is incorporated herein by reference in its entirety. This design was configured to have firearm supports on at least one side of a panel mounted to a slide which could attach to the interior ceiling of the safe or underside of an interior shelf to allow the panel to be extended from the gun safe for easy access to firearms. The design is again directed towards storing long guns which must be stood in a vertical orientation to fit inside the safe.

A pull-out gun racking system is described in U.S. Patent Publication No. 2006/0283820, which is incorporated herein by reference in its entirety. The racking system comprises pull-out gun racks on rails which can be mounted to the bottom surface of an enclosure, thereby allowing the interior space to be used more effectively than for similar designs where the pull-out racks may be mounted to the side walls of the enclosure. The publication discloses that the racks can be made shorter in height to allow for the securing of smaller valuables and firearms.

A gun rack for display purposes is described in U.S. patent Ser. No. 10/321,758, which is incorporated herein by reference in its entirety. The invention teaches a modular firearms-display rack which can be easily broken down and transported. The rack includes grooves into which a pistol shelf can be inserted so that a pistol may be stowed with its butt or handle placed on the shelf while its barrel sits on an angled gun rest. The invention is directed towards the display of firearms and not the efficient use of the interior space of a gun safe.

An expandable modular pistol rack is described in U.S. Pat. No. 7,584,861, which is incorporated herein by reference in its entirety. The invention teaches an expanding modular rack by which pistols can be stored in an upright position in bays having varying widths as desired by the user. The modular rack can be placed on a shelf or on the floor of a gun safe.

Accordingly, there is an unmet need for a means by which to organize and store handguns so that the storage density is high, the guns are easily retrievable, and that shelf or floor space can still be dedicated to long guns, ammunition, or other shooting accessories.

The extendible handgun rack of the present invention incorporates a linear slide having a bearing designed to provide free motion in one direction. Ball bearing slides offering smooth precision motion along a single-axis linear design, aided by ball bearings housed in the linear base, with self-lubrication properties that increase reliability. Constructed from materials such as aluminum, hardened cold rolled steel and galvanized steel, ball bearing slides consist of two linear rows of ball bearings contained by four rods and located on differing sides of the base, which support the carriage for smooth linear movement along the ball bearings. This low-friction linear movement can be powered by hand. The traveling distance of linear recirculating ball bearings is only limited by the length of their rail, as the balls re-circulate inside the bearing's housing. Linear non-recirculating ball bearings have balls installed on a bracket and only move in one axis without re-circulation. Since the balls do not re-circulate, this type of bearings can provide extremely smooth motion. The traveling distance of linear non-recirculating ball bearings is limited by the length of the bracket.

Compound slides can be constructed with two sections or multiple sections. A compound slide typically has a fixed section and a section attached to the equipment. Optionally, a floating intermediate member is disposed there between so the compound slide can extend at least as far as the compressed slide length.

Rack slides are specifically intended for mounting equipment and use friction bearings, ball bearings, or roller bearings. They are sized to fit into racks with mounting flanges on the ends to mate to the mounting holes in racks. In some cases, one mounting flange is formed into the rack slide with an adapter bracket attached to the other end to accommodate different depths of the rack. The outer fixed member is attached to the rack and the inner moving member is generally screwed to the side of the mounted equipment. Rack slides are typically compound or 3-part slides allowing full extension of the mounted equipment and generally include provision for sliding the inner member completely free to allow removal of the equipment from the rack. They can also include stops to prevent accidentally pulling the equipment out of the rack without releasing the stop mechanism.

SUMMARY OF THE INVENTION

The present invention provides a storage device comprising a mounting bracket, a sliding assembly, and at least one mount by which to provide an interface for hanging and storing handguns within a cabinet or other suitable storage space whereby the sliding assembly can project outward from the storage device for unencumbered access to the handguns.

Moreover, the present invention provides a storage device adapted to be attached to a mounting surface, the storage device comprising, consisting essentially of, or consisting of a sliding assembly having a chassis and an inner member slidingly attached to the chassis. A support piece interconnects with the inner member and at least one mount is secured to the support piece. The mount comprises a hanging member having a first neck with a proximal and distal end with the proximal end securing to the support piece and the distal end having a pair of upward facing arms extending oppositely and perpendicularly from the first neck to form a suspension valley which is sufficiently wide to cradle a trigger guard of a handgun. An alignment member having a second neck with a proximal and distal end has the proximal end secured to the support piece. The distal end has a nose and a pair of downward facing arms extending oppositely and perpendicularly from the second neck to form an alignment trough in which a barrel or handle of the handgun may rest. The angle between the hanging member and alignment member of the mount is such that simultaneously the trigger guard of the handgun may be cradled in the suspension valley and the barrel of the handgun may rest in the alignment trough securing the position and orientation of the handgun within the storage device. The storage device may further comprise a finger aperture as a means for assisting the grip of a user attempting to extend or retract the sliding assembly; the finger aperture selected from the group consisting of a lever, a knob, a hook, a handle, an indent, and a hole. Optionally, the storage device may include the feature of having the walls of the distal end of the first neck of the hanging member flare outwards to passively align the trigger guard in the suspension valley. In addition, the walls of the nose at the distal end of the second neck of the alignment member is angled to passively align the resting barrel or handle in the alignment trough.

The extendable gun rack of the present invention can be fabricated using plain bearings or "bushings", a simple friction fit slide, or more preferably a linear ball bearing slide. A compound slide such as shown in FIGS. 7 and 8 may be utilized having two or three sections. A preferred embodiment uses two sections.

Embodiments of the present invention contemplate a novel storage device which can be mounted to a shelf or bottom surface of a lid or cover of an existing gun safe, or any horizontal support structure, to increase its handgun storage capacity while avoiding disadvantages of the prior art. It is contemplated that an end mounting adaptor can be utilized to enable the present invention to be utilized with a rack slide and mounted by one end to a vertical support structure such as a back wall.

In one preferred embodiment a firearms storage device adapted to be attached to a mounting surface, includes a sliding assembly having a chassis and an inner member slidingly attached to the chassis and a support piece interconnected with the inner member. At least one mount secured to the support piece including a hanging member having a first neck with a proximal end and a distal end with the proximal end securing to the support piece and the distal end having a pair of upward facing arms extending oppositely and perpendicularly from the first neck forming a suspension valley having an effective width to cradle a trigger guard or a grip of a handgun. The mount includes an alignment member having a second neck with a proximal end and a distal end with the proximal end securing to the support piece and the distal end having a nose and a pair of downward facing arms extending oppositely and perpendicularly from the second neck forming an alignment trough supporting a barrel of the handgun. The hanging member and the alignment member mounted at an angle from one another and a trigger guard or a grip of the handgun is cradled in the suspension valley and the barrel of the handgun rests in the alignment trough securing a position and orientation of the handgun within the firearms storage device.

In another preferred embodiment, a firearms storage device adapted to be attached to a mounting surface comprising a sliding assembly having a chassis and an inner member slidingly attached to the chassis and a support piece interconnected with the inner member. At least one mount is secured to the support piece including a hanging member having a first neck with a proximal end and a distal end. The proximal end is secured to the support piece and the distal end has a pair of upward facing arms extending oppositely and perpendicularly from the first neck forming a suspension valley having an effective width to cradle a trigger guard of a handgun. The mount including an alignment member has a second neck with a proximal end and a distal end. The proximal end is secured to the support piece and the distal end has a nose and a pair of downward facing arms extending oppositely and perpendicularly from the second neck forming an alignment trough supporting a grip of a smaller handgun. The hanging member and the alignment member are mounted at an angle from one another and the trigger guard of the handgun is cradled in the suspension valley. The grip of the handgun rests in the alignment trough securing a position and orientation of the handgun within the firearms storage device.

It is an objective of the present invention, to mount the extendable handgun rack to a shelf or bottom surface of a lid or cover of an existing gun safe, or any horizontal support structure.

It is a further objective of the present invention to provide a system that allows easy access to all the items being stored in the storage space, regardless of the stored item's position in the storage space (e.g., front, middle, or back).

It is a further objective of the present invention to provide a system that prevents stored items from contacting each other, to minimize the damage to the outer surfaces of the items.

It is another objective to provide an optional retaining means such as a spring or elastomer attaching the sliding inner member to the stationary chassis of the bracket in order to retract the sliding inner member to a resting position nesting in the chassis. It is another object to include at least one releasable stop means to temporarily hold the sliding inner member in an extended position with respect to the chassis such as a spring tab biasing against a detent "hole, crease, lug, slot, or indent".

It is another aspect of embodiments of the present invention to provide a storage device that fits within an interior space of a gun safe or storage cabinet when the storage device is in a retracted position but that can extend fully from the interior space in an extended position.

Thus, one aspect of the present invention provides a storage device comprising a mounting bracket, a sliding assembly, and at least one mount on which at least one handgun can be stored. The handgun can be placed on the mount when the sliding assembly is in at least a partially extended configuration. The handgun can be secured in its enclosure after the sliding assembly is subsequently fully retracted.

One aspect of the invention provides a mounting system for a handgun comprising a hanging member and an alignment member. The trigger guard of the handgun can be suspended from the hanging member and the barrel or handle of the handgun can be balanced and aligned on the alignment member. The mounts of the mounting system are designed to allow for storage of multiple handguns while preventing contact between handguns or with other surfaces of the enclosure to minimize damage to the items being stored. Although the barrel of the handgun typically rests on the alignment member, handguns having shorter barrels may best be balanced and stored by resting the handle on the alignment member instead of the barrel.

Other objects, features, and advantages of the invention will be apparent with the following detailed description taken in conjunction with the accompanying drawings showing a preferred embodiment of the invention.

BRIEF DESCRIPTION OF DRAWINGS

The accompanying drawings are incorporated into and form a part of the specification to illustrate examples of the aspects, embodiments, or configurations disclosed herein. The drawings together with the description, are meant to explain the principle aspects, embodiments, or configurations of the invention. The drawings illustrate preferred and alternative examples of the aspects, but are not intended to limit the aspects, embodiments, or configurations to only the illustrated and described examples. Further features and advantages will become apparent from the following, more detailed, description of the various aspects, embodiments, or configurations, as illustrated by the drawings referenced below. Reference numbers are the same for those elements that are the same across different figures.

DETAILED DESCRIPTION OF THE INVENTION

Figure 1:
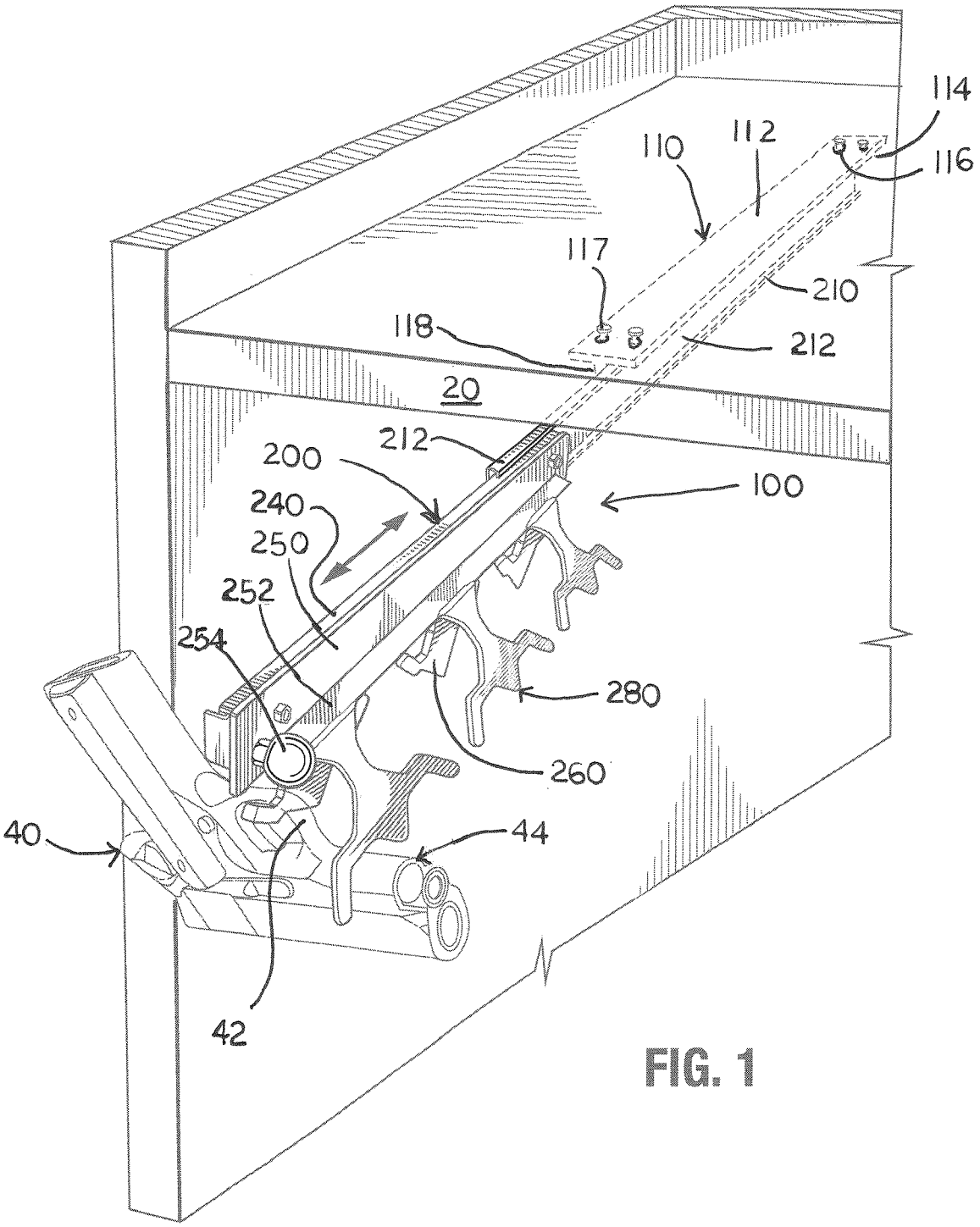
FIG. 1 is a perspective view of a storage device according to one embodiment of the present invention.

Various embodiments of the present invention are described herein and depicted in the drawings. To acquaint persons skilled in the pertinent arts most closely related to the present invention, a preferred embodiment that illustrates the best mode now contemplated for putting the invention into practice is described herein by, and with reference to, the annexed drawings that form a part of the specification. This exemplary embodiment is described in detail without attempting to describe all the various forms and modifications in which the invention might be embodied. As such, the embodiments described herein are illustrative and, as will become apparent to those skilled in the arts, may be modified in numerous ways within the scope and spirit of the invention.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature structure, or characteristic in connection with other embodiments, whether or not explicitly described.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" or "an", "one or more" and "at least one" can be used interchangeably herein.

The use of "including," "comprising," or "having," and variations thereof herein is meant to encompass the items listed thereafter and equivalents thereof as well as additional items. Accordingly, the terms "including," "comprising," or "having," and variations thereof can be used interchangeably herein.

It shall be understood that the terms "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Example embodiments will now be described more fully with reference to the accompanying drawings.

Referring now to FIGS. 1-7, a storage device 100 of one embodiment of the present invention is illustrated in a fully extended configuration. The storage device 100 is configured to hold at least one handgun 40 having a trigger guard 42 and a barrel 44. It will be appreciated by those skilled in the art that the barrel of many fully automatic or semi-automatic pistols have a barrel which is housed within the slide and frame of the handgun. For the purposes of this disclosure, "barrel" should be understood to be the exterior-most surface of the handgun in proximity to the barrel. The storage device and its various components may be formed of various materials including, but not limited to metal, plastic, fiberglass, carbon fiber, and other composite materials.

The storage device 100 has a mounting bracket 110 which has a top surface 112 and a bottom surface 114. The top surface 112 can be mounted flush to the bottom of a horizontal support structure 20. As would be appreciated by one skilled in the art, the horizontal support structure may include structures such as underside of a shelf, counter top, desktop, cabinet, gun safe, and the like. In a preferred embodiment, the top surface 112 of the mounting bracket 110 has a plurality of mounting holes 116 by which a fastening means 117 may be used to affix the mounting bracket 110 to the horizontal support structure 20. The fastening means 117 may include, but is not limited to rivets, screws, nails, staples, or bolts. In an alternative embodiment, the top surface 112 may be secured to the bottom of the horizontal support structure 20 by means of an adhesive, welding, or as a slot and groove interconnect.

A first support piece 118 extends substantially perpendicular from the bottom surface 114 of the mounting bracket 110. In a preferred embodiment, the first support piece 118 extends continuously down the length of the mounting bracket 110. In an alternative embodiment the first support piece 118 may comprise a discontinuous set of supporting sections. It will be appreciated by one skilled in the art that the first support piece and the mounting bracket may be integrally formed by machining or molding to reduce the complexity of the assembly or increase the strength of the storage device.

The storage device 100 further comprises a sliding assembly 200 containing a chassis 210 and an inner member 240. The chassis 210 is affixed substantially parallel to the first support piece 118. The chassis 210 contains a channel 212 for receiving and slidingly attaching to inner member 240.

Additionally, or alternatively, the sliding assembly 200 may include an optional sliding rail to enable the sliding assembly 200 to extend further slidingly interconnecting with the fixed chassis 210 and the inner member 240.

Additionally, or alternatively, the sliding assembly 200 may further comprise ball bearings or rollers to increase the load bearing capacity of the sliding assembly and reduce friction forces experienced by the sliding assembly 200. Optionally, the sliding assembly 200 may be obtained commercially from various suppliers.

Figure 2:
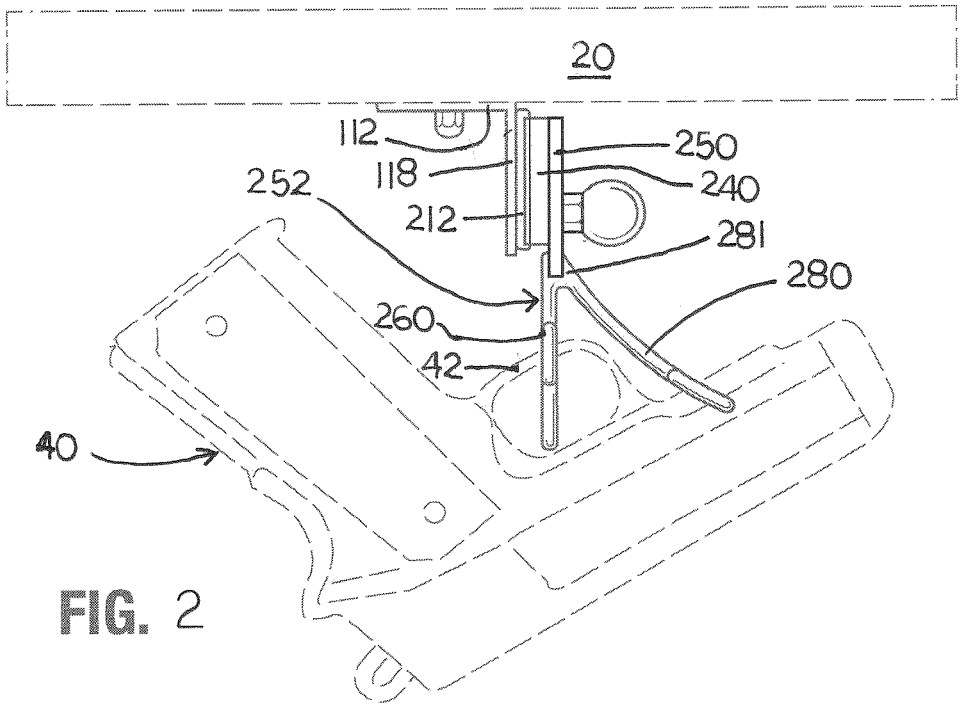
FIG. 2 is an end view of the storage device of FIG. 1.
Figure 8:
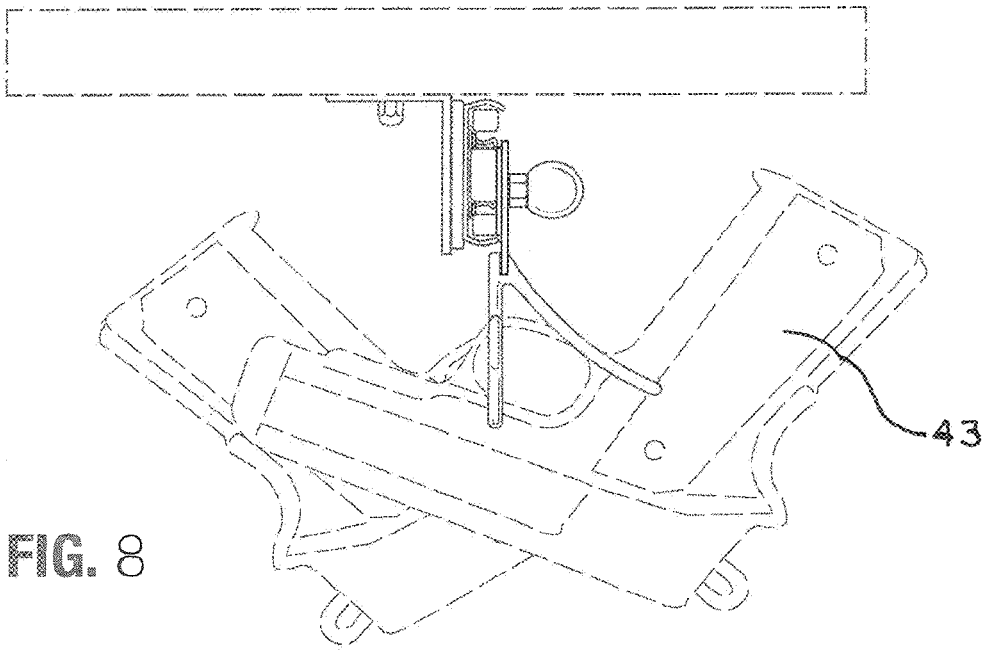
FIG. 8 is a end view of the storage device of FIG. 1 showing a smaller handgun with the grip balanced on and aligned by the alignment member.
Figure 9:
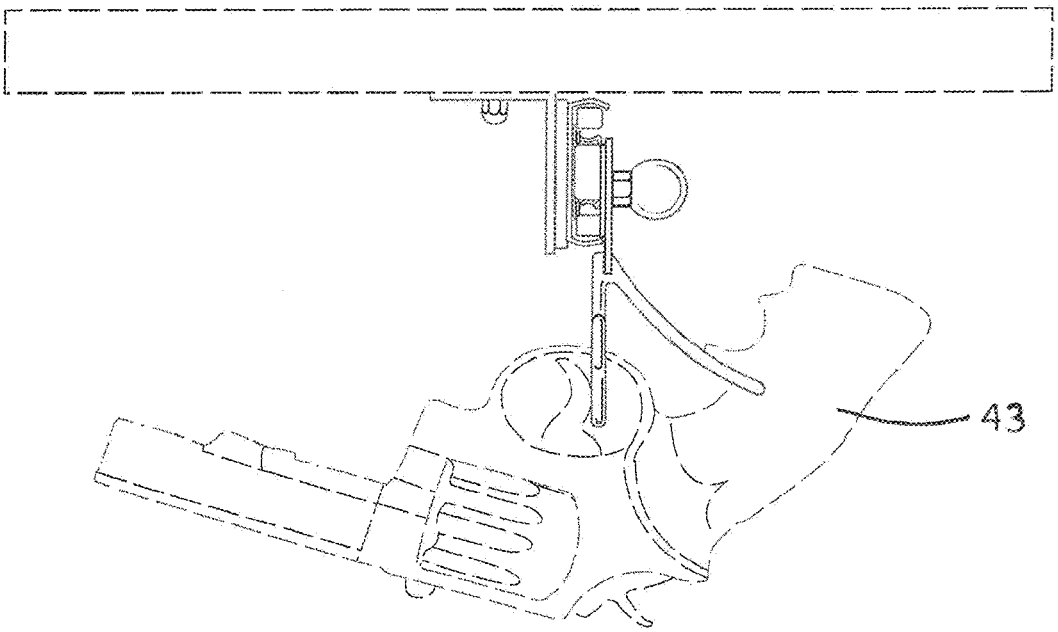
FIG. 9 is a end view of the storage device of FIG. 1 showing a handgun having a shorter barrel having the grip balanced on and aligned by the alignment member.

As best shown in FIG. 2, a second section comprises a support piece 250 which is affixed to the inner member 240. A handgun 40 can be placed on a longitudinal mount 252 which is disposed from the bottom 281 of the second support piece 250 when the sliding assembly 200 is in a compressed state or in at least a partially extended configuration. The mount 252 includes at least one hanging member 260 and at least one alignment member 280. In one preferred embodiment, the hanging member and alignment member are longitudinal strips. The trigger guard 42 hangs from the hanging member 260 and the barrel 44 is balanced on and aligned by the alignment member 280. The geometry and spacing of the hanging member 260 and alignment member 280 are designed so that, if multiple handguns are stored on a plurality of mounts, the handguns will not contact nor damage each other. Optionally, a finger-aperture 254 may be attached to, or formed in, the second support piece 250. The finger-aperture may be selected from the group consisting of a lever, a knob, a hook, a handle, an indent, a hole, a projection, and any other suitable device that can be grabbed or grasped by a used to pull the inner member 240 to an extended position, or conversely pushed to retract the inner member 240. Although the barrel of the handgun typically rests on the alignment member; some smaller handguns or handguns having shorter barrels may best be balanced and stored by resting the handle or grip 43 on the alignment member instead of the barrel as shown in FIGS. 8 and 9.

In a preferred embodiment of the current invention, the hanging member 260 is disposed from the bottom of the second support piece 250 substantially perpendicular to the horizontal support structure 20. The hanging member 260 acts as a fulcrum on which the trigger guard 42 of the handgun 40 can balance. The alignment member 280 is disposed at an angle less than 90 degrees, but more preferably 15 to 75 degrees, more preferably from 25 to 55 degrees, and most preferably at about 45 degrees from the hanging member 260. The first neck 262 of the hanging member 260 and the second neck 282 of the alignment member 280 must be sufficiently long, and the angle of the alignment member 280 relative to the hanging member 260 appropriately designed, to ensure no component of the handgun 40 will touch the horizontal support structure 20 while being stored. It will be appreciated by one skilled in the art that different handgun geometries may require mounts of various lengths, angles, and widths to accommodate different styles of handguns. The mount can be fabricated as an integral one piece molded structure formed from a metal such as aluminum or a plastic, or the hanging member 260 can be affixed to the support piece 250 by rivets, welding, adhesives, bolts, or other means of fastening. In addition, the alignment member may be curved outwardly slightly in order to minimize the angle between the hanging member and alignment member and minimize interference with the trigger guard and the alignment member and still provide optimal support against the bottom portion of the barrel of the upside down hanging handgun.

The sliding assembly 200 is illustrated to be either extendable or retractable. A handgun can be placed on a mount 252 when the sliding assembly 200 is in a retracted stored position, extended position, or in a partially extended configuration; however, the sliding assembly or rack is designed to hold a plurality of handguns, and selection of a handgun is more readily accomplished by extending the rack, out from the chassis. Once the handgun has been placed on the mount 252, the sliding assembly 200 can be retracted fully underneath the horizontal support structure 20.

Figure 3:
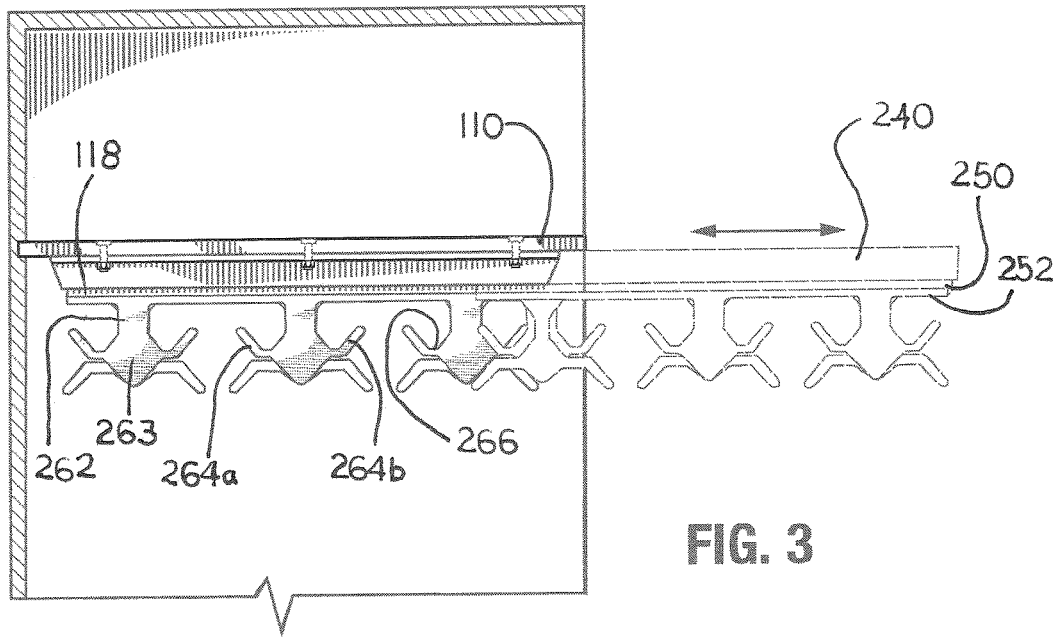
FIG. 3 is a right-side plan view of the storage device of FIG. 1 showing the hanging member and extensibility of the sliding assembly.

Referring now to FIG. 3, the hanging member 260 includes a proximal end defining a first neck 262 extending downward from the bottom of the second support piece 250 and a distal end defining a diamond shaped body 263. A pair of upward facing arms 264*a* and 264*b* extend outward and are angled upward at a selected angle of from 0 to 90 degrees, more preferably from 20 to 70 degrees, and more preferably from 30 to 65 degrees opposite one another extending from the distal end of the first neck 262, parallel to the length of the mounting bracket 110. The upward facing arms 264 have a suspension valley 266 sufficiently wide to securely cradle the trigger guard 42 of a handgun 40. The upward facing arms 264 are angled upwards sufficiently to prevent the trigger guard 42, and therefore the handgun 40, from slipping off the mount 252 when the sliding assembly 200 is extended or retracted. The distal end of the first neck 262 is flared outwards to passively center the trigger guard 42 in the suspension valley 266 of the upward facing arms 264. The hanging member may extend vertically down from the support member 250 or may be angled negatively or positively about the support member based on the geometry of the handgun to be stored.

Figure 4:
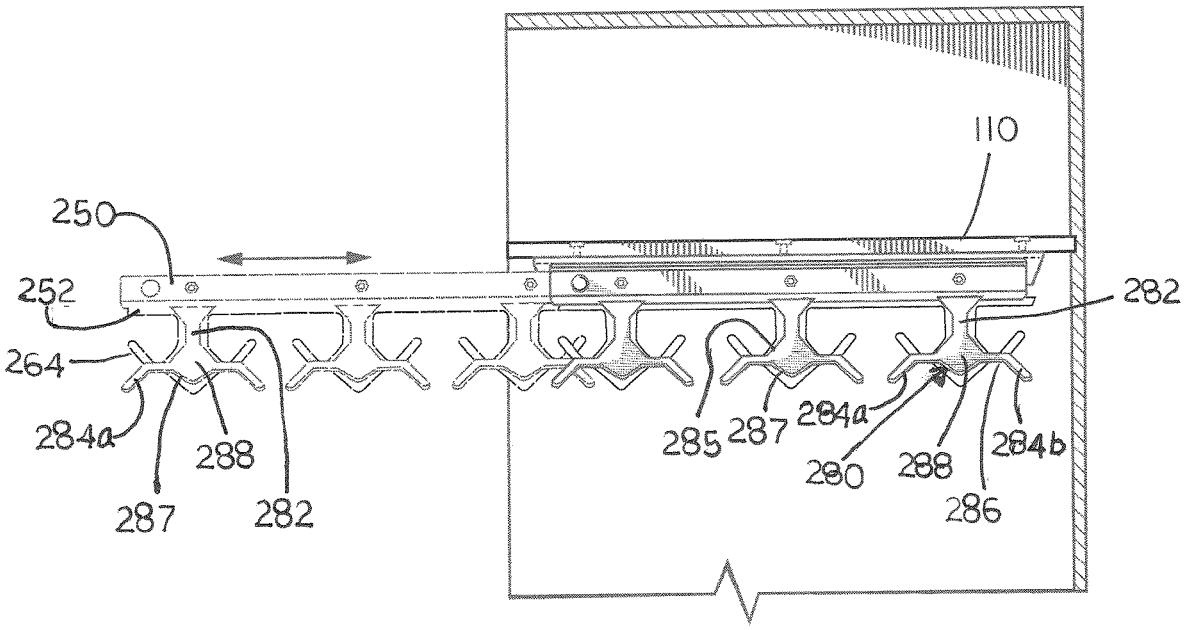
FIG. 4 is a left-side plan view of the storage device of FIG. 1 showing the alignment member and the extensibility of the sliding assembly.

Referring now to FIG. 4, the longitudinal mount 252 of the alignment member 280 joining the hanging member 260 may include a recess or groove or being affixed thereto by welding or formed from a single piece of material by molding. The alignment may project outward straight or include an upward curve. The alignment member 280 includes a second neck 282 having a proximal end and a distal end defining an enlarged diamonds shaped body 288 extending from the distal end of the second neck, 282, with the proximal end extending from the bottom 281 of the second support piece 250. A pair of opposing downward facing arms 284*a* and 284*b* extend oppositely from the distal end of the second neck 282, parallel to the length of the mounting bracket 110. The diamond shaped body 288 and the opposing downward facing arms 284*a* and 284*b* extend a distance from the distal end of the second neck 282 sufficient to create an alignment trough 286 in which the barrel 44 of the handgun 40 may rest. In one preferred embodiment, the angle of the inner side walls 285 of the diamond shaped body 288 are approximately equal to the angle of the upward facing arms 264 to passively center the barrel 44 in the alignment trough 286, and the angle of the outer side walls 287 of the diamond shaped body 288 are approximately equal to the angle of the downward facing arms 284 to passively center the barrel 44 in the alignment trough 286. The center of the alignment trough 286 is approximately aligned with the center of the suspension valley 266.

When more than one mount 252 is attached to the second support piece 250, the mounts are sufficiently spaced so that the gap between distal ends of the upward facing arms 264 of the hanging members 260 and the gap between the distal ends of the downward facing arms 284 of the alignment members 280 provide enough space so that a handgun 40 may be easily stored and retrieved by a user.

Figure 5:
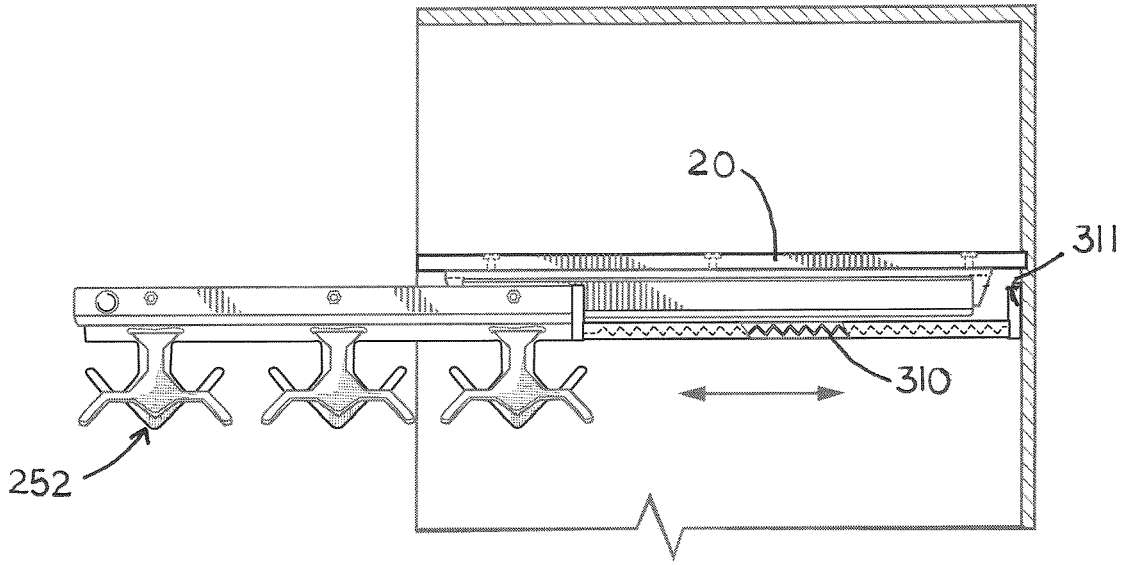
FIG. 5 is a side plan view of one embodiment of the sliding assembly of the present invention featuring a soft-close mechanism.
Figure 6:
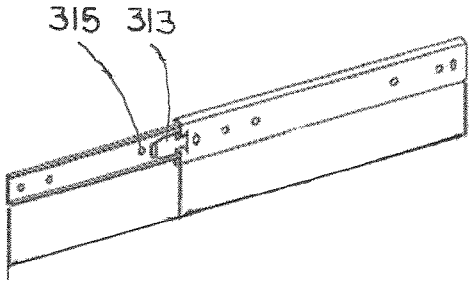
FIG. 6 is a perspective view of a two section compound slide.
Figure 7:
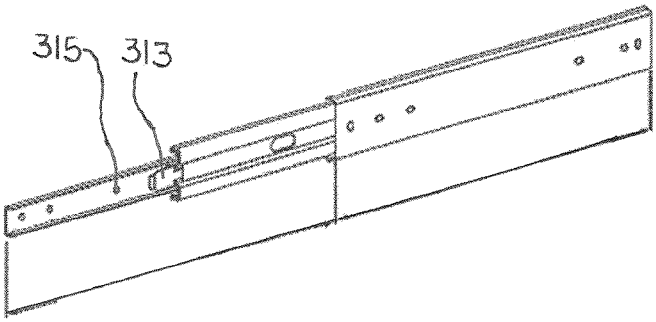
FIG. 7 is a perspective view of a three section compound slide.

Referring now to FIG. 5, an optional soft-close mechanism 310 provides a retractable slide means for the user to move to the extended slide back into the retracted position. As illustrated, a soft-close mechanism, shown as a spring, interconnects to the chassis 210 and the inner member 240. The retractable means such as the spring 310 or elastomer attaches the sliding inner member to the stationary chassis of the bracket in order to retract the sliding inner member to a resting position nesting in the chassis. A cushioning stop means 311 such as a plastic or rubber bumper may be affixed to the vertical wall of the cabinet and positioned so that the slide abuts the bumper upon returning to the compresses storage position. At least one releasable stop means 313 may be included to temporarily hold the sliding inner member in an extended position with respect to the chassis such as a spring tab biasing against a detent 315 "hole, crease, lug, slot, or indent".

The mount 352 may have a coating 354 to prevent damage or marring to the exterior surfaces or finishes of the handgun. Optional coatings may include an elastomeric or polymeric material such as silicone, rubber, or plastic. The mount 452 may have a covering 454, to prevent damage or marring to the exterior surfaces or finishes of the handgun. Optional coverings may include a soft non-scratching fabric, foam, or felt.

In all the embodiments described herein, when the sliding assembly is at least partially extended, the user has easy, unrestricted access to the mounts on which to store handguns. The invention described herein provides a convenient and high-density storage solution for storing handguns, without occupying precious shelf or floor space in an enclosure such as a gun safe.

The disclosure has been described with reference to various specific embodiments and techniques. However, it should be understood that many variations and modifications may be made while remaining within the spirit and scope of the invention.

It is appreciated that certain features of the invention, which are, for clarity, described in the context of separate embodiments, may also be provided in combination in a single embodiment. Conversely, various features of the invention that are, for brevity, described in the context of a single embodiment, may also be provided separately or in any sub-combination.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplifications presented herein above. Rather, what is intended to be covered is within the spirit and scope of the appended claims.

I claim:

1. A storage device adapted to be attached to a mounting surface, the storage device comprising:

a sliding assembly having a chassis and an inner member slidingly attached to the chassis;

a support piece interconnected with the inner member; and at least one mount secured to the support piece; said mount comprising:

a hanging member having a first neck with a proximal and distal end; the proximal end securing to the support piece and the distal end having a pair of upward facing arms extending oppositely and perpendicularly from said first neck to form a suspension valley which is sufficiently wide to cradle a trigger guard of a handgun;

an alignment member having a second neck with a proximal and distal end; the proximal end securing to the support piece and the distal end having a nose and a pair of downward facing arms extending oppositely and perpendicularly from said second neck to form an alignment trough in which a barrel of the handgun rests;

wherein the angle between the hanging member and alignment member of the mount is such that simultaneously the trigger guard of the handgun is cradled in the suspension valley and the barrel of the handgun rests in the alignment trough, thereby securing the position and orientation of the handgun within the storage device.

2. The storage device of claim 1, further comprising a finger aperture as a means for assisting the grip of a user attempting to extend or retract the sliding assembly the finger aperture is selected from the group consisting of a lever, a knob, a hook, a handle, an indent, and a hole.

3. The storage device of claim 1, wherein the walls of the distal end of the first neck of the hanging member are flared outwards to passively align the trigger guard in the suspension valley, and the walls of the nose at the distal end of the second neck of the alignment member is angled to passively align the resting barrel in the alignment trough.

4. The storage device of claim 1, wherein the sliding assembly includes a soft-close mechanism.

5. The storage device of claim 1, wherein the sliding assembly includes ball-bearings.

6. The storage device of claim 1, wherein the sliding assembly includes an additional sliding rail to increase the extension of the sliding assembly.

7. The storage device of claim 1, wherein the angle between the hanging member and alignment member of the mount is less than 180 degrees.

8. The storage device of claim 1, wherein the mount has a protective coating to prevent marring or damage to the exterior surfaces of a stored item, said protective coating being selected from a group consisting of silicone, a rubber, a plastic a non-scratching fabric, a foam, a felt, and combinations thereof.

9. The storage device of claim 1, wherein the spacing between consecutively secured mounts is sufficient for storing multiple handguns.

10. The storage device of claim 1, wherein the angle between the hanging member and alignment member of the mount is less than 90 degrees.

11. The storage device of claim 1, wherein the angle between the hanging member and alignment member of the mount is between 15 to 75 degrees.

12. A storage device adapted to be attached to a mounting surface, the storage device comprising:

a sliding assembly having a chassis and an inner member slidingly attached to the chassis;

a support piece interconnected with the inner member; and at least one mount secured to the support piece; the at least one mount comprising a hanging member and an alignment member;

the hanging member having a first neck with a proximal end and a distal end the proximal end of the hanging member securing to the support piece and the distal end having a pair of upward facing arms extending oppositely and perpendicularly from said first neck to form a suspension valley of an effective width to cradle a trigger guard of a handgun and the distal end of the first neck being flared outwards to passively center the trigger guard;

an alignment member having a second neck with a proximal end and a distal end, the proximal end securing to the support piece and the distal end, the alignment member comprising a nose and a pair of downward facing arms extending oppositely and perpendicularly from said second neck to form an alignment trough cooperatively engaging a barrel of the handgun having a center of mass behind a balance point of the trigger guard rests; and a pair of upward facing arms extending oppositely and perpendicularly from said first neck to form an alignment valley having an effective width to cradle a barrel of the handgun having said center of mass forward of the balance point of the trigger guard; and wherein an angle between the hanging member and the alignment member of the mount is such that the trigger guard of the handgun is cradled in a suspension valley and the barrel of the handgun rests in the alignment valley thereby securing the position and orientation of the handgun within the storage device.

13. The storage device of claim 12, further comprising a finger aperture as a means for assisting the grip of a user attempting to extend or retract the sliding assembly, the finger aperture selected from the group consisting of a lever, a knob, a hook, a handle, an indent, and a hole.

14. The storage device of claim 12, wherein the walls of the distal end of the first neck of the hanging member are flared outwards to passively align the trigger guard in the suspension valley, the walls of the nose at the distal end of the second neck of the alignment member is angled outward to passively align the resting barrel in the alignment trough for the handgun having a center of mass behind the balance point of the trigger guard, and the walls of the distal end of the second neck of the alignment member are flared outwards to passively align the resting barrel of the handgun having a center of mass forward of the trigger guard.

15. The storage device of claim 12, wherein the sliding assembly includes a soft-close mechanism.

16. The storage device of claim 12, wherein the sliding assembly includes ball-bearings.

17. The storage device of claim 12, wherein the sliding assembly includes an additional sliding rail to increase the extension of the sliding assembly.

18. The storage device of claim 12, wherein the angle between the hanging member and alignment member of the mount is less than 180 degrees.

19. The storage device of claim 12, wherein the mount has a protective coating to prevent marring or damage to the exterior surfaces of a stored item, said protective coating being selected from a group consisting of a silicone, a rubber, a plastic, a non-scratching fabric, a foam, a felt, and combinations thereof.

20. A firearms storage device adapted to be attached to a mounting surface, comprising:

a sliding assembly having a chassis and an inner member slidingly attached to said chassis;

a support piece interconnected with said inner member;

at least one mount secured to said support piece, said mount including a hanging member having a first neck with a proximal end and a distal end, said proximal end securing to said support piece and said distal end having a pair of upward facing arms extending oppositely and perpendicularly from said first neck forming a suspension valley having an effective width to cradle a trigger guard of a handgun;

said mount including an alignment member having a second neck with a proximal end and a distal end, said proximal end securing to said support piece and said distal end having a nose and a pair of downward facing arms extending oppositely and perpendicularly from said second neck forming an alignment trough supporting a barrel of said handgun;

said hanging member and said alignment member mounted at an angle from one another and said trigger guard of said handgun is cradled in said suspension valley and said barrel of said handgun rests in said alignment trough securing a position and orientation of said handgun within said firearms storage device.

21. The firearms storage device of claim 20, further comprising a finger aperture as a means for assisting the grip of a user attempting to extend or retract the sliding assembly, said finger aperture selected from the group consisting of a lever, a knob, a hook, a handle, an indent, and a hole.

22. The firearms storage device of claim 20, wherein the walls of the distal end of the first neck of the hanging member are flared outwards to passively align the trigger guard in the suspension valley and the walls of the nose at the distal end of the second neck of the alignment member is angled to passively align the resting barrel in the alignment trough.

23. The firearms storage device of claim 20, wherein the sliding assembly includes a soft-close mechanism.

24. The firearms storage device of claim 20, wherein the sliding assembly includes an additional sliding rail to increase the extension of the sliding assembly.

25. The firearms storage device of claim 20, wherein the mount has a protective coating to prevent marring or damage to the exterior surfaces of a stored item said protective coating being selected from a group consisting of silicone, a rubber, a plastic, a non-scratching fabric, a foam, a felt, and combinations thereof.

26. The firearms storage device of claim 20, wherein the spacing between consecutively secured mounts is an effective spacing for storing multiple handguns thereon.

27. The firearms storage device of claim 20, wherein the angle between the hanging member and alignment member of the mount is less than 180 degrees.

28. The firearms storage device of claim 20, wherein the angle between the hanging member and alignment member of the mount is between 15 to 75 degrees.

29. The firearms storage device of claim 20, wherein the angle between the hanging member and alignment member of the mount is less than 90 degrees.

30. A firearms storage device adapted to be attached to a mounting surface comprising:

a sliding assembly having a chassis and an inner member slidingly attached to said chassis;

a support piece interconnected with said inner member;

at least one mount secured to said support piece, said mount including a hanging member having a first neck with a proximal end and a distal end, said proximal end securing to said support piece and said distal end having a pair of upward facing arms extending oppositely and perpendicularly from said first neck forming a suspension valley having an effective width to cradle a trigger guard of a handgun;

said mount including an alignment member having a second neck with a proximal end and a distal end, said proximal end securing to said support piece and said distal end having a nose and a pair of downward facing arms extending oppositely and perpendicularly from said second neck forming an alignment trough supporting a grip of said handgun;

said hanging member and said alignment member mounted at an angle from one another and said trigger guard of said handgun is cradled in said suspension valley and said grip of said handgun rests in said alignment trough securing a position and orientation of said handgun within said firearms storage device.

31. The firearms storage device of claim 30, further comprising a finger aperture as a means for assisting the grip of a user attempting to extend or retract the sliding assembly, said finger aperture selected from the group consisting of a lever, a knob, a hook, a handle, an indent, and a hole.

32. The firearms storage device of claim 30, wherein the walls of the distal end of the first neck of the hanging member are flared outwards to passively align the trigger guard in the suspension valley and the walls of the nose at the distal end of the second neck of the alignment member is angled to passively align the resting grip in the alignment trough.

33. The firearms storage device of claim 30, wherein the sliding assembly includes a soft-close mechanism.

34. The firearms storage device of claim 30, wherein the sliding assembly includes an additional sliding rail to increase the extension of the sliding assembly.

35. The firearms storage device of claim 30, wherein the mount has a protective coating to prevent marring or damage to the exterior surfaces of a stored item said protective coating being selected from a group consisting of silicone, a rubber, a plastic, a non-scratching fabric, a foam, a felt, and combinations thereof.

36. The firearms storage device of claim 30, wherein the spacing between consecutively secured mounts is an effective spacing for storing multiple handguns thereon.

37. The firearms storage device of claim 30, wherein the angle between the hanging member and alignment member of the mount is less than 180 degrees.

38. The firearms storage device of claim 30, wherein the angle between the hanging member and alignment member of the mount is between 15 to 75 degrees.

39. The firearms storage device of claim 30, wherein the angle between the hanging member and alignment member of the mount is less than 90 degrees.

* * * * *